US007985014B2

(12) United States Patent
Tsukamoto

(10) Patent No.: US 7,985,014 B2
(45) Date of Patent: Jul. 26, 2011

(54) LIGHT SOURCE MODULE

(75) Inventor: Hironori Tsukamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 209 days.

(21) Appl. No.: 12/498,400

(22) Filed: Jul. 7, 2009

(65) Prior Publication Data

US 2010/0008095 A1 Jan. 14, 2010

(30) Foreign Application Priority Data

Jul. 8, 2008 (JP) ..... 2008-177816

(51) Int. Cl.
*F21V 7/04* (2006.01)

(52) U.S. Cl. ..... 362/549; 362/507; 362/508

(58) Field of Classification Search ..... 362/549, 362/507, 508, 523
See application file for complete search history.

(56) References Cited

U.S. PATENT DOCUMENTS

| | | | | |
|---|---|---|---|---|
| 6,533,445 | B1 * | 3/2003 | Rogers | 362/540 |
| 7,118,261 | B2 * | 10/2006 | Fredericks et al. | 362/545 |
| 2005/0040672 | A1 * | 2/2005 | Andre | 296/187.09 |
| 2009/0296418 | A1 * | 12/2009 | Luo et al. | 362/516 |

FOREIGN PATENT DOCUMENTS

JP 2005-209537 A 8/2005

* cited by examiner

*Primary Examiner* — Ali Alavi
(74) *Attorney, Agent, or Firm* — Sughrue Mion, PLLC

(57) ABSTRACT

A light source module is provided. The light source module includes a light emitting element; a module substrate on which the light emitting element is mounted; a support member comprising a position reference section; and a fixing member which fixes the module substrate to the support member. The module substrate includes a positioning section which determines a position of the module substrate; and a displacement force generation section which imparts a displacement force onto the module substrate so as to bring the positioning section into contact with the position reference section of the support member when the fixing member is fastened to the support member.

5 Claims, 10 Drawing Sheets

LIGHT SOURCE MODULE

BACKGROUND OF THE INVENTION

1. Field of the Invention

The present disclosure relates to a light source module having a light-emitting element, such as a light-emitting diode (LED), as a light source and that is suitable for use as a light source of a lamp fitting, such as an illuminating lamp of a vehicle.

2. Description of Related Art

In a recent vehicle, a related art lamp that uses a light-emitting element, such as an LED, as a light source element has been proposed in order to save energy expended in operation of the lamp when the lamp is used in head lamps and/or tail lamps. An example of such a related art lamp is described, for example, in Japanese Patent Unexamined Publication No. JP-A-2005-209537. In a lamp of this type, an LED is mounted, for example, on a power feeding substrate, and the substrate is implemented on a module substrate, to thus make up a light source module. Alternatively, an LED might be mounted directly on a module substrate, to form a light source module. The thus-configured light source module is built in a lamp unit including a reflector and a collecting lens, and is used as a light source of in a related art lamp unit.

In the related art lamp unit having a light source module of this type, a luminous point of an LED element serving as a light source is narrower than a luminous point of an incandescent electric lamp, and the like. Hence, in order to acquire a desired luminous intensity distribution characteristic, a luminous point of an LED element must be positioned with high accuracy. Accordingly, in JP-A-2005-209537, circular-arc projections are provided on a portion of a substrate making up a light source module, and the projections are brought into contact with a portion of an LED seat of the lamp unit, thereby horizontally positioning the light source module on the lamp unit.

In JP-A-2005-209537, the light source module is mounted on a seat and supported while being pinched on the seat by a clip of a leaf spring. The light source module is concurrently pressed toward one side of the seat by spring force of the clip so as to bring the projections on the substrate into contact with a side wall surface of the seat, thereby positioning the light source module. However, when using the clip, there is a disadvantage in that vibrations and the like developed in a vehicle would cause the clip to fall or cause a deterioration of the spring force of the clip that would result in a decrease in pinching force, which in turn might cause the light source module to move over the seat or fall off from the seat. For these reasons, it is possible to fastening the light source module to the seat by means of screws.

When the light source module is fastened with a screw, the light source module does not largely move over the seat or fall off from the seat. However, if the light source module is fixedly supported simply by means of screws, the positioning accuracy of the light source module is deteriorated by the tolerance between the screws and threaded holes. Therefore, the light source module is positioned and fastened with screws while being held in a positioned state.

However, in this case, an operation for holding a positioned state and an operation for fastening the light source module with screws must simultaneously be performed, which makes an assembly operation complicated and difficult. In particular, when the light source module is fastened with screws, the force used to fasten the screws is transmitted to the light source module, which makes it easy to develop rotational force in the light source module. The rotational force might pose difficulty in holding the light source module in the positioned state, which would also cause a decrease in positioning accuracy.

SUMMARY OF THE INVENTION

An illustrative aspect of the present invention is to provide a light source module that is to be fastened with fastening member such as a screw and that enables fastening of the light source module with high positional accuracy regardless of tolerance between the fixing member and also enables simplification of operation for assembling the light source module by automatically performing positioning simultaneously with fastening.

According to an illustrative aspect of the present invention, there is provided a light source module including:

a light emitting element;

a module substrate on which the light emitting element is mounted;

a support member including a position reference section; and a fixing member which fixes the module substrate to the support member, wherein the module substrate includes:

a positioning section which determines position of the module substrate; and a displacement force generation section which imparts displacement force onto the module substrate so as to bring the positioning section into contact with the position reference section of the support member when the fixing member is fastened to the support member.

DETAILED DESCRIPTION OF EXEMPLARY EMBODIMENTS OF THE PRESENT INVENTION

First Exemplary Embodiment

Figure 1:
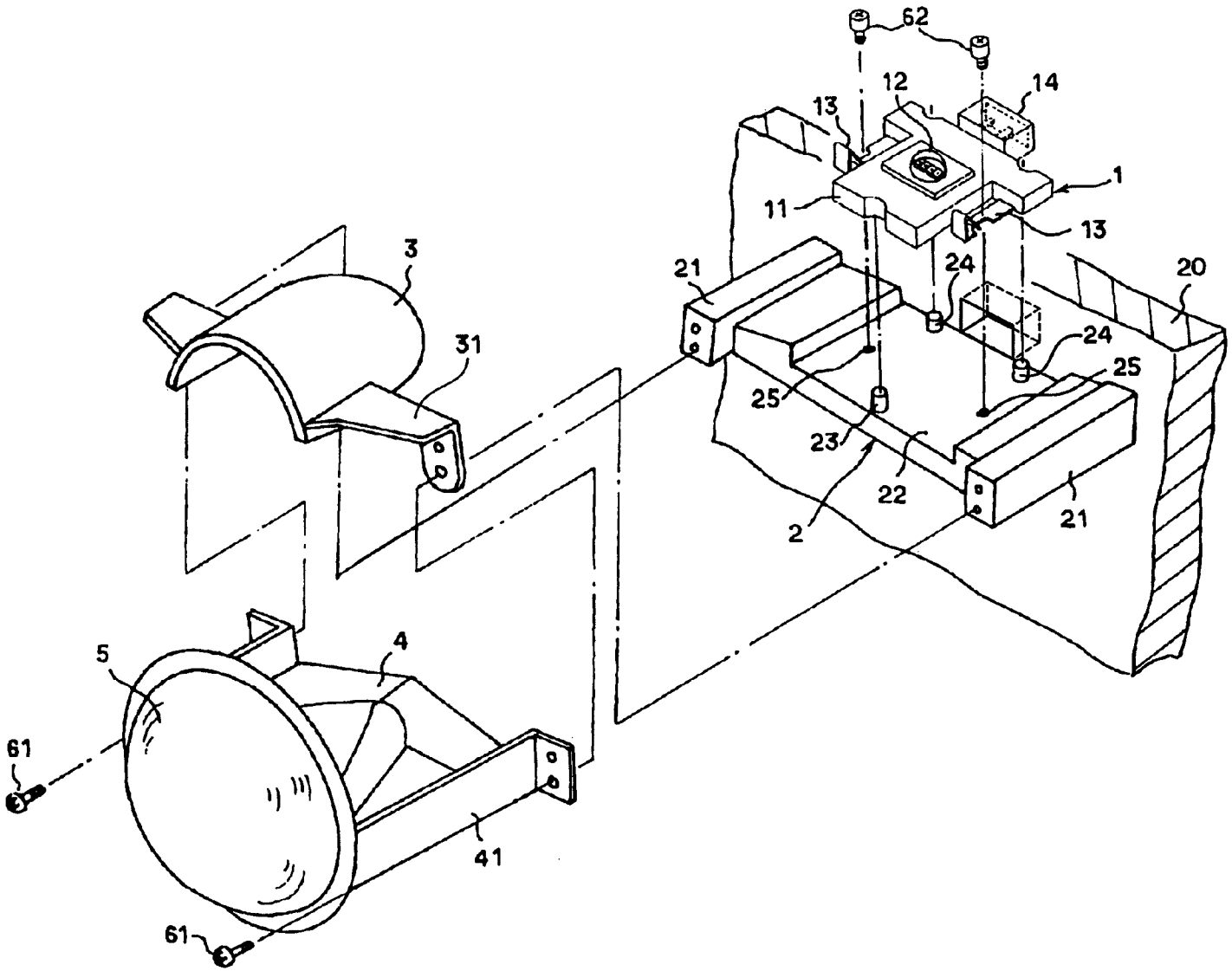
FIG. 1 is a partially-exploded schematic perspective view of a lamp unit to which a light source module according to exemplary embodiments of the present invention is applied.
Figure 2:
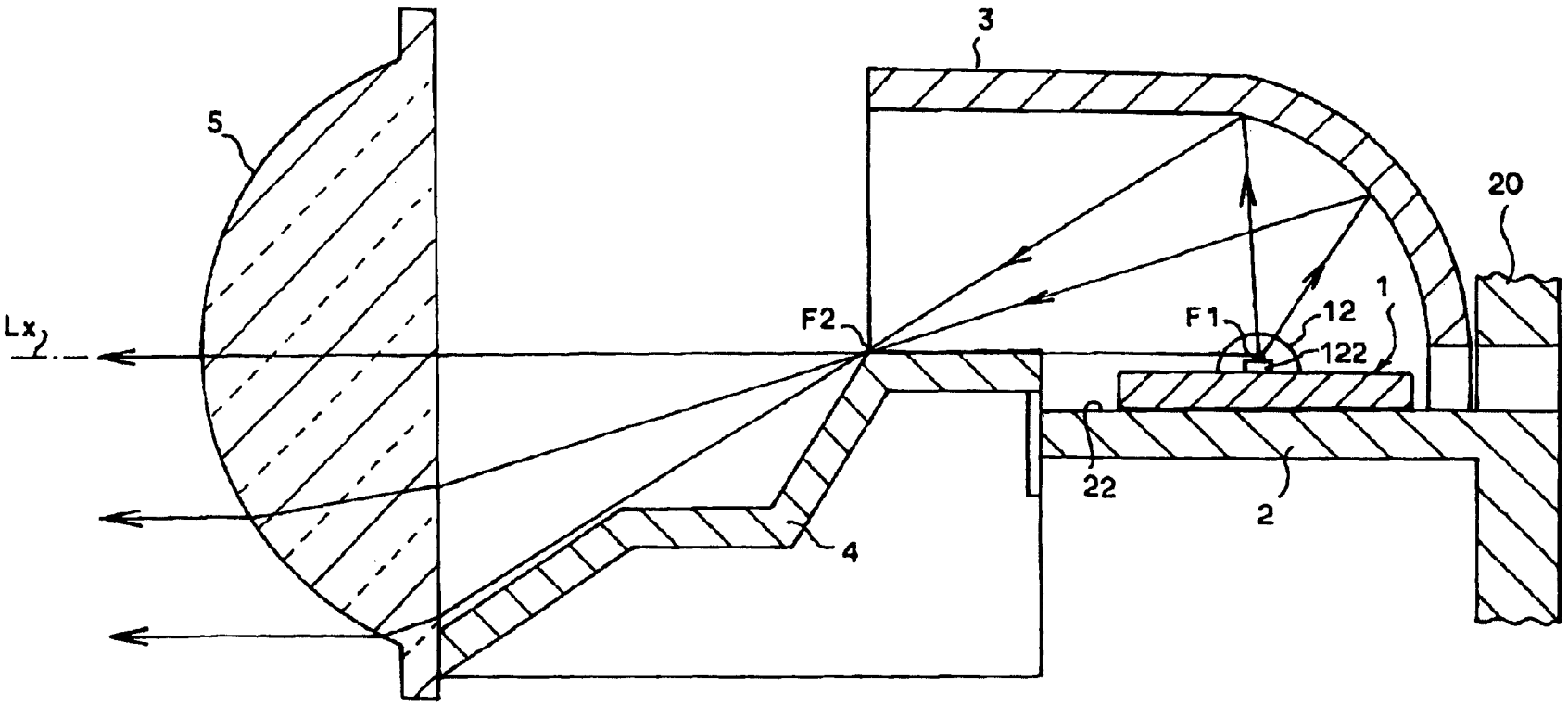
FIG. 2 is a schematic cross-sectional view of the lamp unit of FIG. 1 taken along an optical axis of the lamp unit.

A first exemplary embodiment of the present invention will now be described with reference to FIGS. 1 and 2. The lamp unit of the first exemplary embodiment includes a light source module 1; a seat 2 fixedly supporting the light source module 1; and a reflector 3, an auxiliary reflector 4, and a collecting lens 5 that are supported by the seat 2. The reflector 3 is made so as to have a spheroidal shape partially truncated so as to become open forward of the lamp unit. An interior surface of the reflector 3 is made as a reflecting surface by applying a surface treatment, such as aluminum deposition, thereto and arranged so as to cover an area above the seat 2. The auxiliary reflector 4 extends over an area ahead of and below the seat 2, and a portion of the auxiliary reflector 4 also functions as a shade. A bracket 31 is provided on either side of the reflector 3, and a bracket 41 is provided on either side of the auxiliary reflector 4. The brackets 31 and 41 are fastened to respective front end faces of arms 21 of the seat 2 with the screws 61, thereby assembling the seat 2, the reflector 3, and the auxiliary reflector 4 into one unit. The collecting lens 5 is provided at a lower edge thereof and is supported by respective front ends of the brackets 41 of the auxiliary reflector 4.

The seat 2 is made of an aluminum die casting, or the like. A heat sink 20 for heat dissipation is made integrally on the back of the seat or coupled integrally to the same by means of screws, or the like. A region sandwiched between both arms 21 is made as a support surface 22 formed from a horizontal flat surface. The light source module 1 is fixedly supported on the support surface 22 with fixing screws 62. The light source module 1 employs a light emitting diode (LED) as a light source. In a state in which the light source module 1 is fixedly supported on the support surface 22, the light source module is positioned in such a way that, on the assumption that a line connecting a first focal point F1 to a second focal point F2 of the reflector 3 is taken as a lamp optical axis Lx of the lamp unit, a luminous point of the light source module 1; namely, a luminous pint of an LED chip 122 built in the light source module 1 as will be described in detail later, coincides with the first focal point F1, and the second focal point F2 is caused to substantially match a posterior focal point of the collecting lens 5.

In the lamp unit, light emitted from the LED chip 122 of the light source module 1 exits in the form of a light beam that is slightly dispersed in an upward direction and undergoes reflection on the reflector 3. Since the luminous point of the LED is arranged at the first focal point F1 of the reflector 3, the reflected light is directed toward the second focal point F2. A portion of the light is blocked by the auxiliary reflector 4 at the second focal point F2, but the unblocked light passes through the collecting lens 5, to thus exit forward of the lamp. Since the posterior focal point of the collecting lens 5 substantially coincides with the second focal point F2 of the reflector 3, the light passing through the collecting lens 5 comes into a nearly-collimated beam. The shape of the light beam passing through the collecting lens 5 is limited by appropriately setting the geometry of the auxiliary reflector 4, whereby illumination is performed in a desired light distribution pattern. In relation to actual headlamps of a vehicle, a plurality of lamp units, each of which has such a configuration, are provided. The lamp units are built in a lamp body of one headlamp in a specified pattern. The LEDs are illuminated by electric power supplied from a vehicle-mounted battery, to thus acquire a specified luminous intensity.

Figure 3:
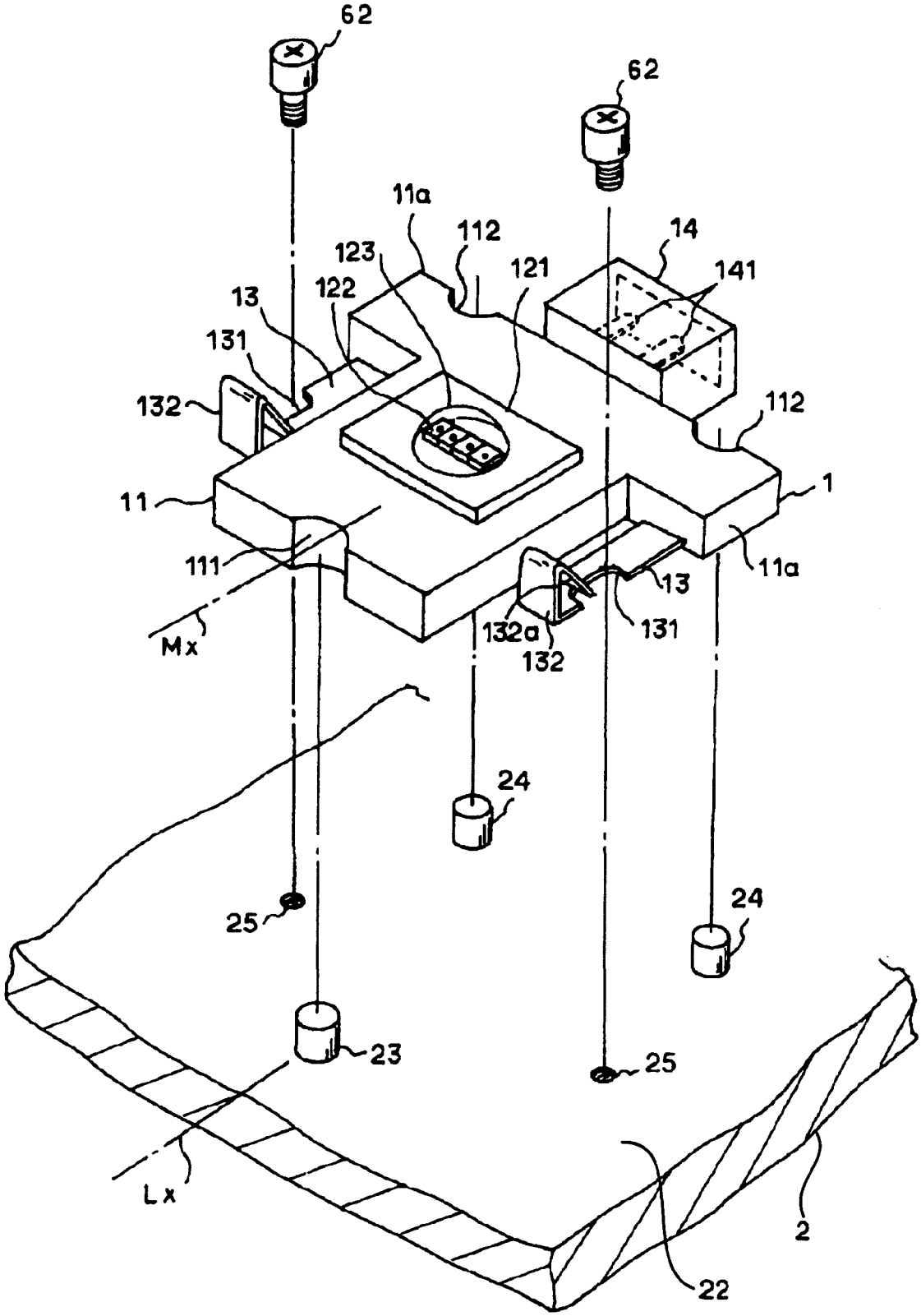
FIG. 3 is a partially-exploded perspective view of a portion of the light source module according to a first exemplary embodiment of the present invention.
Figure 4:
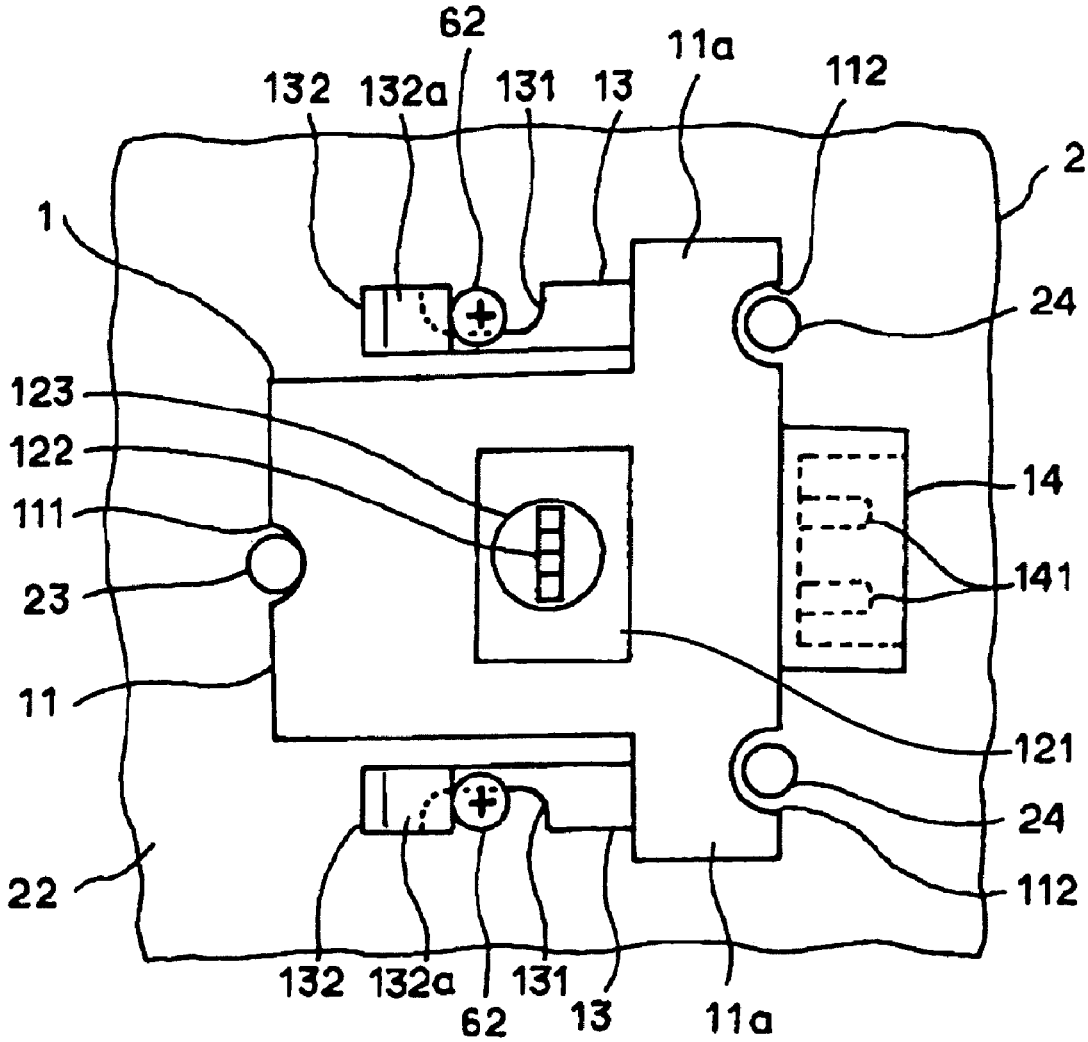
FIG. 4 is a plan view of the light source module of FIG. 3.

FIG. 3 is an exploded perspective view of a portion for describing the structure that fixedly supports the light source module 1 on the support surface 22 of the seat 2, and FIG. 4 is a plan view of the portion. The support surface 22 of the seat 2 is made in such a way that the vertical level of the luminous point of the LED chip 122 of the light source module 1; namely, the vertical level of the same achieved when the lamp unit is horizontally positioned, matches the first focal point F1 of the reflector 3 when the light source module 1 is mounted. A columnar reference pin 23 is arranged upright at a position on the support surface 22 along the lamp optical axis Lx. A pair of columnar auxiliary pins 24 are provided upright at positions on the support surface 22 at the back of the reference pin 23, so as to assume a triangular pattern with the reference pin 23. The reference pin 23 and the auxiliary pins 24 are made integrally on the seat 2. Further, a pair of fixing screw holes 25 are opened at substantially middle positions on the support surface 22 between the reference pin 23 and the respective auxiliary pins 24.

The light source module 1 has a module substrate 11 made of an insulating plate exhibiting high thermal conductivity, such as ceramic and a resin, or the like. Although unillustrated in the drawings, an interconnection made of a conductive film having a given pattern is made on the surface of the module substrate 11, and an LED package 12 is mounted on the surface. The LED package 12 is made in such a way that a plurality of LED chips 122 are mounted individually on a rectangular package base 121. The number of LED chips 122 is selected in order to acquire a specified luminous intensity; for instance, four LED chips in this exemplary embodiment. Alternatively, integrally-fabricated LED chips may be used. The plurality of LED chips 122 are arranged in line along a direction orthogonal to a module optical axis Mx of the light source module 1 and an optical member 123, such as a spherical dome-shaped transparent cover or lens, is arranged so as to cover the LED chips 122. Although unillustrated in the drawing, electrodes electrically connected to the LED chips 122 are laid out on the package base 121. The electrodes are electrically connected to the interconnection laid on the module substrate 11 when the LED package 12 is mounted on the module substrate 11, to thus be able to establish electrical connections to the LED chips 122.

A region of the module substrate 11 where the LED package 12 is mounted assumes a substantially-square, planar shape. Arms 11*a* outwardly project from both sides that are at the rear of the substantially-square region along the module optical axis Mx, so that the module substrate, on the whole, assumes a planar shape close to the shape of the letter T. A circular-arc reference indentation 111 is cut in the widthwise center position along the front edge of the module substrate 11. A pair of circular-arc auxiliary indentations 112 are cut in positions along a rear edge of the module substrate 11 corresponding to the respective arms 11*a*. The reference indentation 111 and the auxiliary indentations 112 are positioned so as to correspond to the reference pin 23 and the auxiliary pins 24 provided upright on the support surface 22 of the seat 2, respectively.

In the module substrate 11, a pair of support spring plates 13 are provided so as to extend forwardly from the pair of respective arms 11*a* along the module optical axis Mx. The support spring plates 13 each are manufactured by working a strip-shaped leaf spring, and rear ends of the support spring plates are coupled and supported integrally on the respective arms 11*a* of the module substrate 11. The coupled structure can be an integrally-molded structure, a coupled structure using machine screw, or the like. A semi-oblong screw insert indentation 131 is cut in a portion of an outer edge of each of the support spring plates 13, and fixing screws 62 to be screw-engaged with the respective fixing screw holes 25 provided in the support surface 22 are inserted into the respective screw insert indentations 131. On front-end sides of the respective support spring plates 13 with reference to the screw insert indentations 131, there are provided substantially-triangular tapered portions 132 that are made by upwardly bending front-end portions and further bending the same in a backward direction. In particular, the backwardly-bent portions of the tapered portions 132 are made as slopes 132*a*. The slopes 132*a* are extended up to positions at which the slopes are in proximity to the screw insert indentations 131.

A connector 14 is supported integrally on a substantially-center position along a rear edge of the module substrate 11 in the widthwise direction of the module substrate 11, and a contact terminal 141 of the connector 14 is electrically connected to the aforementioned interconnection of the module substrate 11. An unillustrated external connector can fit into the connector 14, and electric power of a vehicle-mounted battery is fed to the interconnection of the module substrate 11 by way of the external connector and further to the LED chips 122 by way of the electrode of the LED package 12, thereby illuminating the LED chips 122.

Figure 5A:
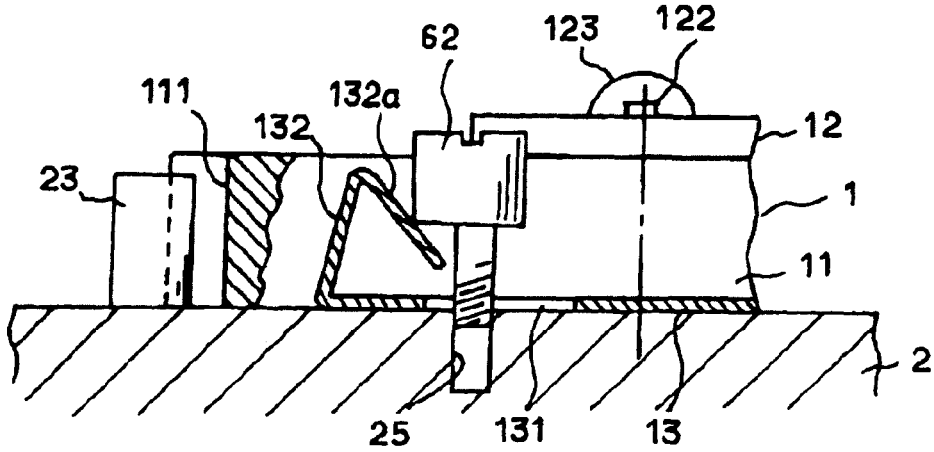
FIGS. 5A to 5C are side views for explaining an operation for positioning the light source module of the first exemplary embodiment.

As shown in a partially-broken right side view of FIG. 5A, in order to mount the light source module 1 on the seat 2 of the lamp unit, the light source module is placed on the support surface 22 while the reference indentation 111 of the module substrate 11 is aligned to the corresponding reference pin 23 of the seat 2. The two auxiliary indentations 112 are aligned to their corresponding auxiliary pins 24 at this time, and hence the light source module 1 is substantially positioned to the seat 2. Specifically, the module optical axis Mx of the light source module 1 is substantially aligned to the lamp optical axis Lx. (see FIG. 3). Subsequently, the two fixing screws 62 are screw-engaged with the fixing screw holes 25 of the seat 2. The respective fixing screws 62 pass through the respective screw insert indentations 131 of the pair of support spring plates 13 at this time. Hence, as the fixing screws 62 are screw-engaged with the fixing screw holes 25, the support spring plates 13 are pressed against the support surface 22. The fixing screws 62 are finally fastened while the support spring plates 13 are sandwiched between the fixing screws 62 and the support surface 22. The module substrate 1 is fixedly supported on the seat 2 by virtue of resultant fastening force.

Figure 5B:
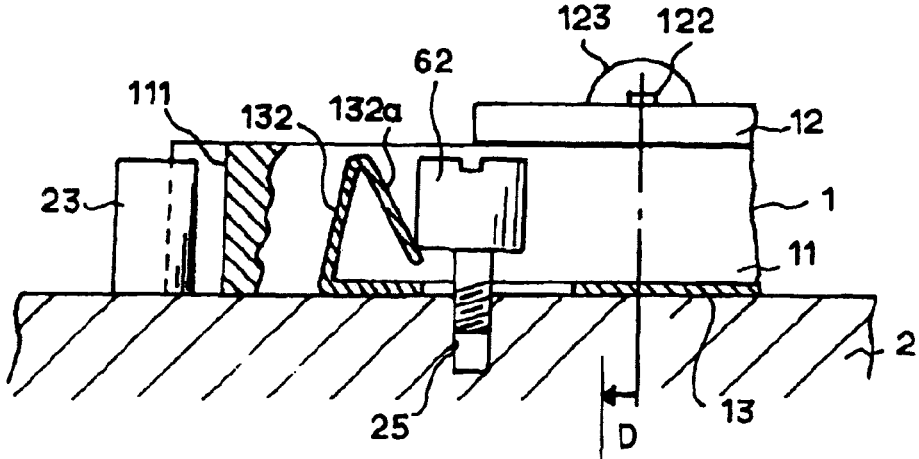
Figure 5C:
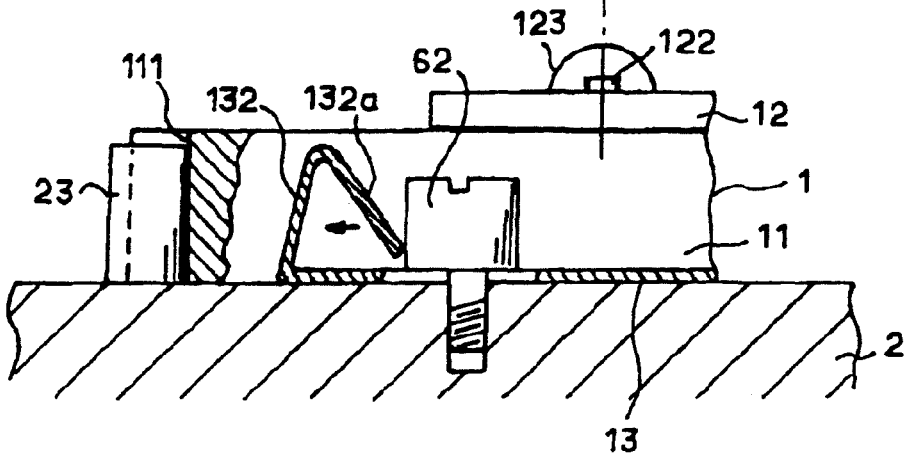

The light source module 1 is fixedly supported on the seat 2 as mentioned above. However, as shown in FIG. 5A, as the fixing screws 62 are further fastened, single sides of respective heads of the fixing screws 62 contact the slopes 132*a* of the support spring plates 13. As the fixing screws 62 are further fastened, areas of the fixing screws 62 contacting the slopes 132*a* are downwardly moved as shown in FIG. 5B, and thus the contacting force increases along with the downward movement. Therefore, the slopes 132*a* are elastically deformed toward the front-end sides of the respective support spring plates 13. Deformation of the slopes 132*a* further proceeds, and an elastic restoration force of the tapered portions 132 eventually increases. As shown in FIG. 5C, the elastic restoration force is exerted on the respective fixing screws 62 in a front to back direction of the lamp unit (i.e., toward the rear of the lamp unit), and a reactive force counter to the elastic restoration force develops in the support spring plates 13, whereupon a displacement force that causes displacement forward of the lamp unit develops in the module substrate 11 integrated with the support spring plates 13. The module substrate 11 is forwardly moved by the displacement force, in a displaced manner, by a dimension D until a recessed surface of the reference indentation 111 contacts the reference pin 23, whereby the light source module 1 is positioned to the reference pin 23 along the lamp optical axis Lx of the light source module. Specifically, the tapered portions 132 of the support spring plates 13 comprise a displacement force generation section, and the reference pin 23 and the reference indentation 111 comprise a position reference section and positioning sections, respectively.

Such a displacement force, which stems from the fastening screw 62 and the support spring plate 13 and which acts on the module substrate 11, develops on both sides of the module substrate 11 with the module optical axis Mx sandwiched therebetween. Hence, the module substrate 11 is positioned with respect to the reference pin in a horizontally-balanced manner. Consequently, so long as the reference pin 23, the reference indentation 111, and the module substrate 11 are designed in such a way that, when the reference pin 23 contacts the reference indentation 111, the luminous point of the LED package 12 coincides with the position of the light source of the lamp unit—namely, the first focal point F1 of the reflector 3 in the lamp optical axis Lx—the luminous point of the LED package 12 can be positioned within the lamp unit with high accuracy by fixedly supporting the light source module 1 on the seat 2. Since the LED package 12 includes the plurality of LED chips 122 (in this case, four) arranged in a direction orthogonal to the module optical axis Mx and the lamp optical axis Lx, the luminous point has a width in a lateral direction perpendicular to the optical axes Lx and Mx. Even when a positional deviation arises from the tolerance between the fixing screws 62 and the fixing screw holes 25 in a direction perpendicular to the optical axes Lx and Mx, the deviation will be insignificant.

As mentioned above, even when a tolerance is developed in the fixing screws 62 used for fastening the light source module 1, the light source module 1 is automatically positioned to the seat 2 by means of only fastening the fixing screws 62. Therefore, an operation for holding the module substrate 11 in a positioned state, which has been performed when the fixing screws 62 are fastened, becomes obviated, and an assembly operation can be simplified. Moreover, when the light source module 1 is fastened to the seat 2, the tapered portions 132 of the support spring plates 13 remain, while being elastically deformed, in contact with the fixing screws 62. Hence, loosening of the fixing screws 62 is prevented by virtue of the contact force. Even if the fixing screws 62 are slightly loosened, or the like, the light source module 1 is held in a state of being pressed against the referenced pin 23 by the contact force, and hence positional deviation will not occur. Therefore, the reliability of fixed support can be maintained for a long period of time.

Figure 6A:
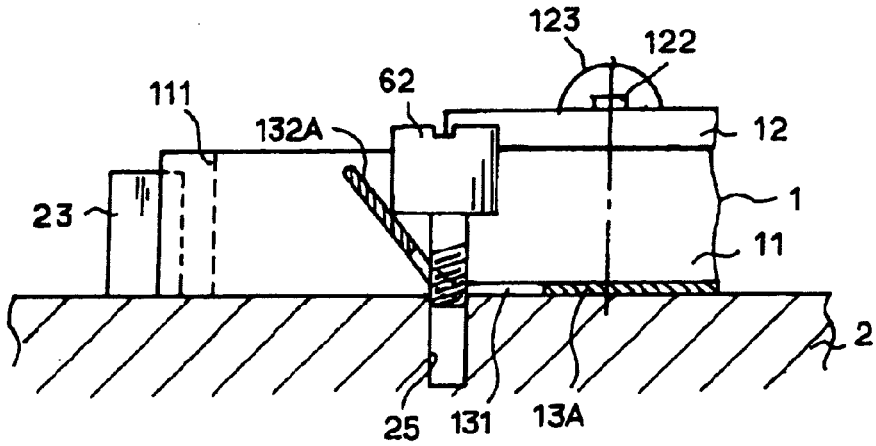
FIGS. 6A to 6C are side views of a modification of the first exemplary embodiment.
Figure 6B:
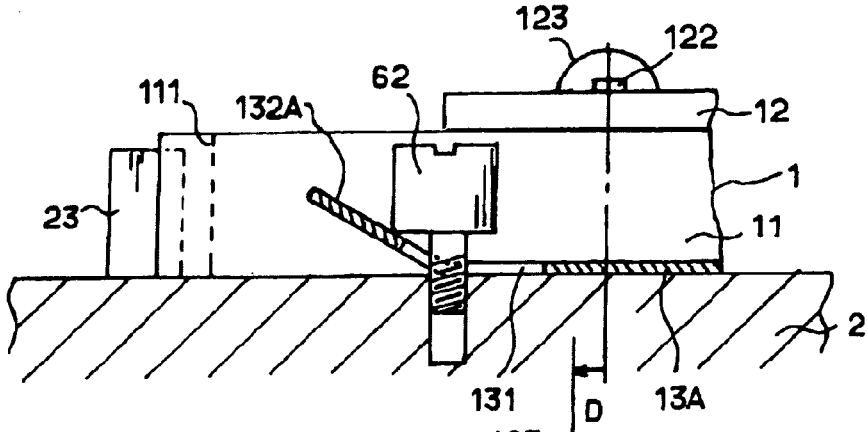
Figure 6C:
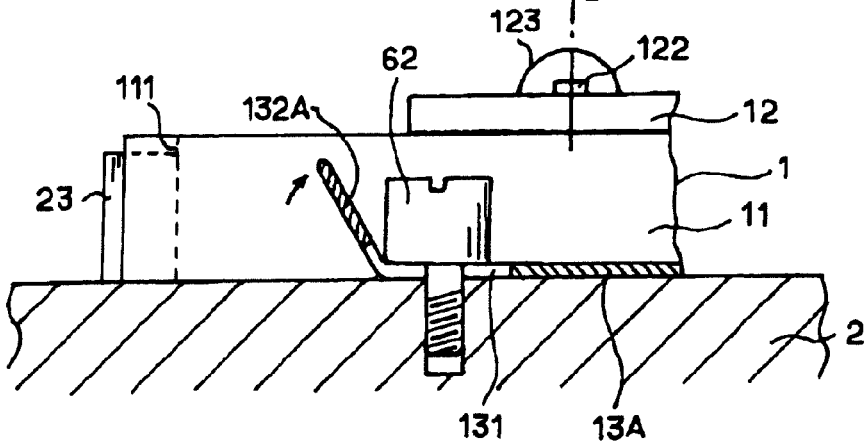

In the first exemplary embodiment, as shown in the right side view of FIG. 6A, the support spring plate 13A can also be made in the shape of a simple tongue, and the support spring plate can also be configured so as to include a tapered portion 132A made by curving a region, which ranges from the area where the screw insert indentation 131 is to be made to the front-end portion, so as to be tilted in an upper forward direction. By means of this configuration, as the fixing screws 62 are fastened to the fixing screw holes 25 of the seat 2 as shown in FIG. 6B, the fixing screws 62 contact the tapered portions 132A, thereby elastically deforming the tapered portions 132A in a downward direction. Therefore, as shown in FIG. 6C, when an elastic restoration force of the tapered portions 132A has developed as a reactive force counter to the fixing screws 62, a displacement force directed forward of the lamp unit develops in the module substrate 11. The reference indentation 111 is forwardly moved by the dimension D by the displacement force until the reference indentation 111 contacts the reference pin 23, whereby the light source module 1 is positioned and simultaneously fixed to the seat 2. The configuration is advantageous for simplifying the configuration of the support spring plate 13A.

Figure 7A:
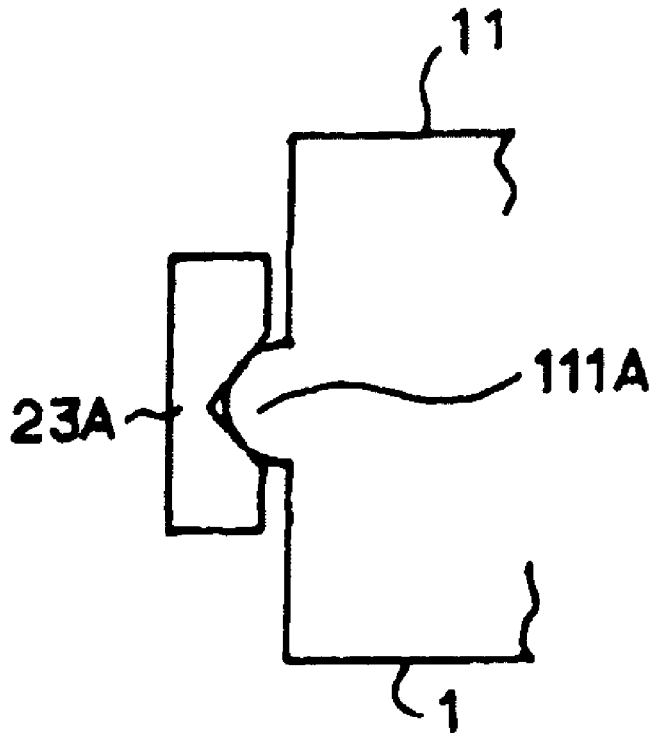
FIGS. 7A and 7B are plan views of a portion of the modification of the first exemplary embodiment.
Figure 7B:
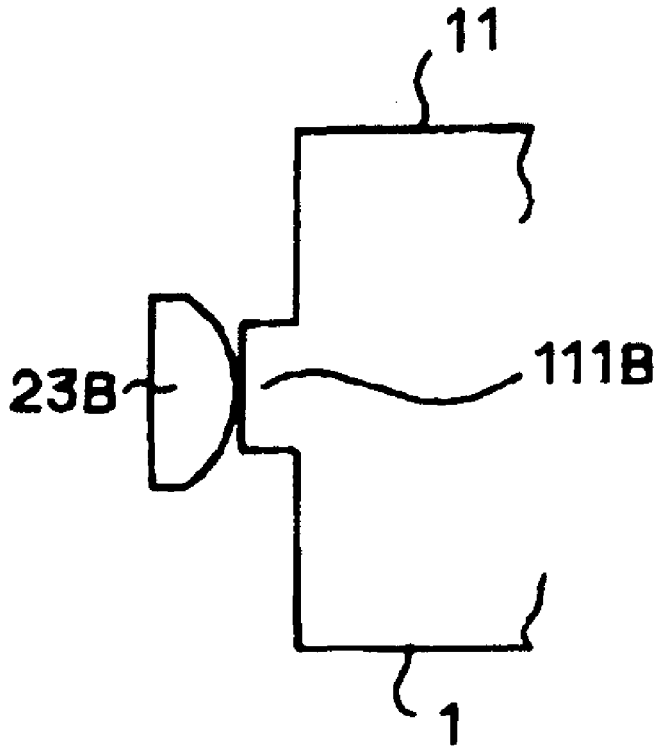

In the first exemplary embodiment, as shown in FIG. 7A, it may also be possible to make, in place of the positioning structure implemented by contacting of the reference pin 23 with the reference indentation 111, a circular-arc projection 111A on the module substrate 11 and provide the support surface 22 of the seat 2 with a reference wall 23A having a V-shaped slit that is to contact the circular-arc projection 111A. As a result of the circular-arc surface of the projection 111A contacting V-shaped surface of the slit of the reference wall 23A, positioning in the optical direction and positioning in the direction orthogonal to the optical axis become possible. In the case of the light source module 1 in which the plurality of LEDs are arranged in a direction orthogonal to the optical axes Lx and Mx as in the first exemplary embodiment, positional accuracy of the direction orthogonal to the optical axes Lx and Mx may be less rigorous. Hence, as shown in FIG. 7B, the module substrate 11 can also be provided with a contact projection 111B having a flat leading-end face, and the support surface 22 can also be provided with a reference wall 23B having a circular-arc face that is to contact the contact projection 111B. The circular-arc surface of the reference wall 23B can also be a flat surface. Although omitted from the drawings, the screw insert indentations made in the respective support spring plates can also be provided in the form of circular screw insert holes.

Second Exemplary Embodiment

Figure 8:
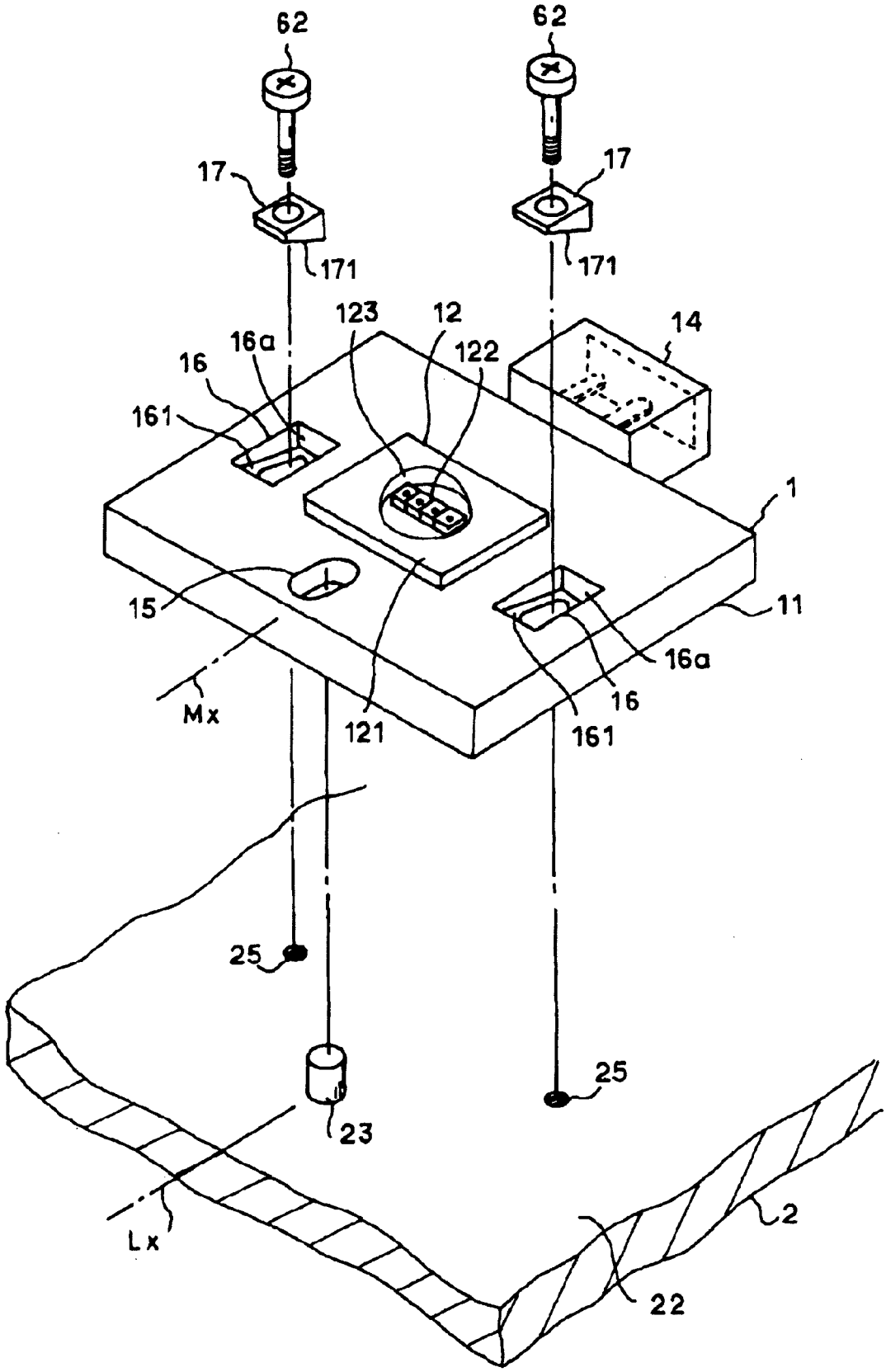
FIG. 8 is a partially-exploded perspective view of a portion of a light source module according to a second exemplary embodiment of the present invention.

FIG. 8 is a perspective view of a light source module of a second exemplary embodiment, and elements equivalent to those of the first exemplary embodiment are assigned like reference numerals. In the second exemplary embodiment, the LED package 12 is mounted at a position, on the module optical axis Mx and on the surface of the module substrate 11 made into the shape of a rectangular flat plate. Electric power is fed to the LED package 12 by way of the interconnection laid on the module substrate 11 and the connector 14, thereby illuminating the LED chips. An oblong reference hole 15 is opened at a front-side position on the module substrate 11 in the module optical axis Mx. A pair of screw insert holes 16 are opened at both positions that are behind the reference hole 15 and that have the module optical axis Mx sandwiched therebetween. As also can be seen in a cross-sectional structure of FIG. 9A, each of the screw insert holes 16 is made up of an upper-level portion 16*a* and a lower-level portion 16*b*. The upper-level portion 16*a* that is at an elevated position in the thicknesswise direction of the plate of the module substrate 11 is a hole having a rectangular, flat shape whose long sides are aligned in the direction of the module optical axis Mx. The lower-level portion 16*b* that is at a lower position in the same direction is a hole having an oblong, flat shape whose long axis is aligned to the direction of the module optical axis Mx. The screw insert hole 16 has, as a bottom surface of the upper-level portion 16*a*, a tapered surface 161 tilted so as to create an ascending slope toward the front of the module optical axis Mx, and a collar 17 to be described later can be fitted into the upper-level portion 16*a*. The dimension of the hole of the lower-level portion 16*b* achieved in the direction of the long axis is made slightly larger than the outer dimension of the fixing screw 62.

The seat 2 is essentially the same as that described in connection with the first exemplary embodiment. However, the columnar reference pin 23 stands upright at a portion of the support surface 22 on the lamp optical axis Lx. The pair of fastening screw holes 25 are opened at positions that are on both sides of the lamp optical axis Lx. The fastening screw holes 25 and the reference pin 23 comprise a triangle with the reference pin 23 as an apex. The reference pin 23 is formed in a columnar shape whose diameter is smaller than the dimension of a minor axis of the reference hole 15 of the light source module 1. The fixing screws 62 are screw-engaged with the fixing screw holes 25.

Figure 9A:
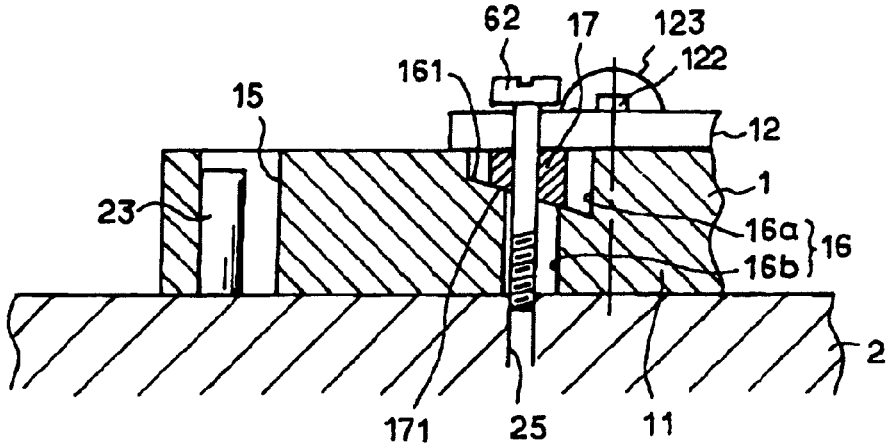
FIGS. 9A to 9C are side views for explaining an operation for positioning the light source module of the second exemplary embodiment.

In order to mount the light source module 1 of the second exemplary embodiment on the seat 2 of the lamp unit, the reference hole 15 of the module substrate 11 is inserted into the reference pin 23 on the support surface 22 of the seat 2, thereby placing the light source module on the support surface 22. Subsequently, the two fixing screws 62 are inserted into the screw insert holes 16 from above and screw-engaged with the fixing screw holes 25 of the support surface 22. Also, as shown in FIG. 9A, collars 17 are fitted into the respective upper-level portions 16*a* of the screw insert holes 16 of the module substrate 11. Each of the collars 17 is made so as to assume a square shape whose four sides are substantially equal in dimension to the short side of the screw insert hole 16. A lower surface of the collar 17 is made as a tapered surface 171 that corresponds to the tapered surface 161 of the upper-level portion 16*a* of the screw insert hole 16. After being inserted into the center hole of the collar 17, the fixing screw 62 is inserted into the screw insert hole 16, to thus be screw-engaged with the fixing screw hole 25.

Figure 9B:
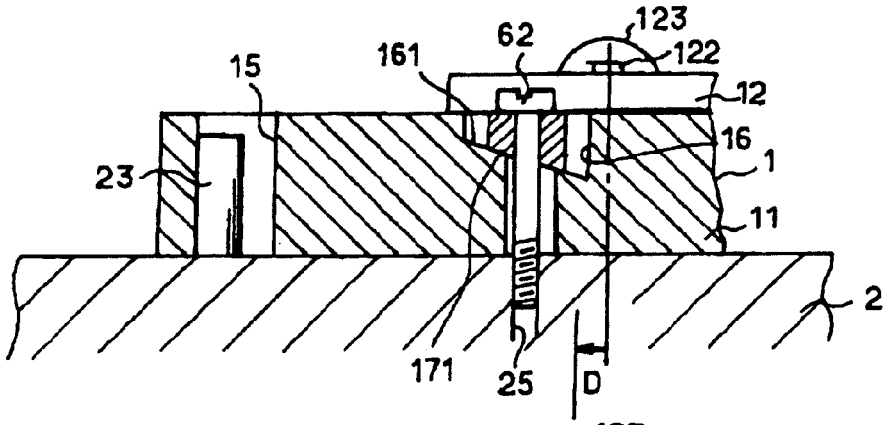
Figure 9C:
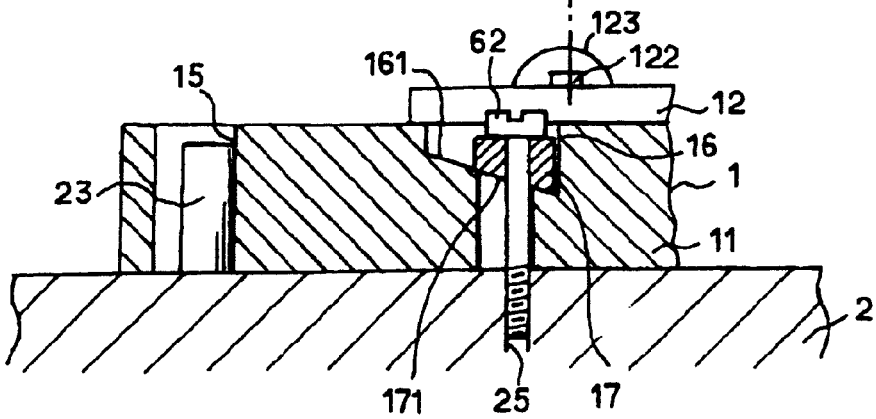

Therefore, as the fixing screw 62 is screw-engaged with the fixing screw hole 25, the lower tapered surface 161 of the collar 17 is brought into contact with the tapered surface 171 of the upper-level portion 16*a*, as shown in FIGS. 9B and 9C. Wedging action between the tapered surfaces 161 and 171 induced by the contact causes a displacement force in the module substrate 11 for causing a forward displacement along the lamp optical axis Lx. As a result, the module substrate 11 is moved forwardly along the lamp optical axis Lx by a dimension D. An interior surface of the reference hole 15 contacts the reference pin 23, whereby the module substrate 11 is positioned to the reference pin 23. Specifically, the tapered surface 171 of the collar 17 and the tapered surface 161 of the screw insert hole 16 comprise a displacement force generation section. The reference pin 23 and the reference hole 15 comprise a position reference section and positioning section, respectively. The light source module 1 is thereby positioned to the seat 2. The displacement force exerted on the light source module 1 by the screw insert holes 16 and the collars 17 develop in both sides of the module substrate 11 with the module optical axis Mx sandwiched therebetween. Accordingly, the module substrate 11 is positioned to the reference pin 23 in a horizontally-balanced state, so that the light source module 1 can be positioned within the lamp unit at high accuracy.

Therefore, in the second exemplary embodiment, even when a tolerance exists in the fixing screws 62, the light source module 1 is automatically positioned by means of fastening the fixing screws 62. Hence, an operation for holding the module substrate 11 in a positioned state, which has hitherto been performed when the fixing screws 62 are fastened, become obviated, and assembly operation can be simplified.

Figure 10:
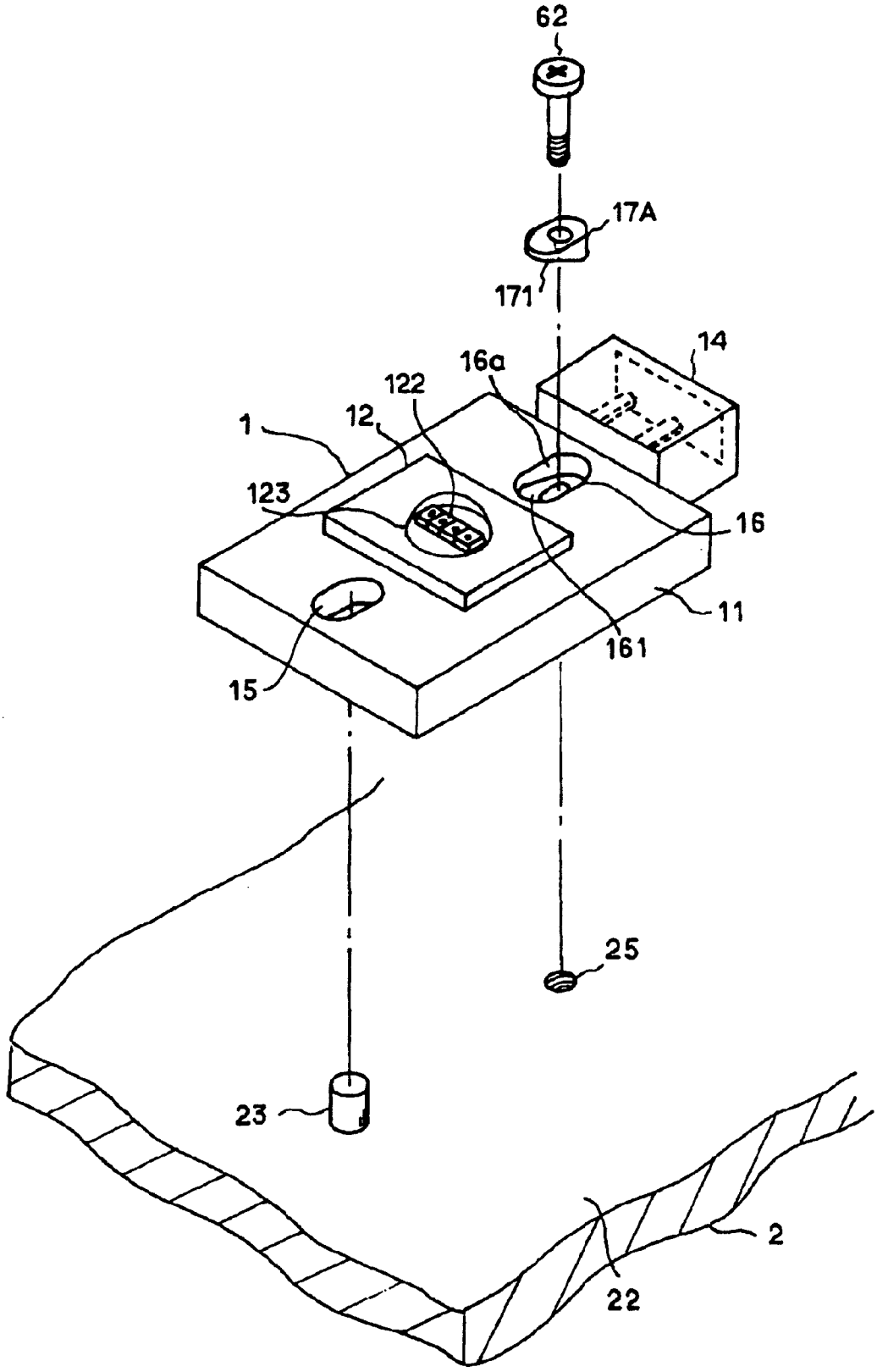
FIG. 10 is a partially-exploded perspective view of a modification of the second exemplary embodiment.

As shown in FIG. 10, the light source module of the second exemplary embodiment can alternatively be arranged so as to have only one screw insert hole 16A in the module substrate 11 along the optical axis and to fixedly support the module substrate on the support surface 22 of the seat 2 by use of only one fixing screw 62 and one collar 17A. By means of such a configuration, a number of components can be decreased, and the configuration may be simplified further. Moreover, further simplification of the assembly operation becomes possible. In this case, the screw insert hole 16A is made in the form of an oblong hole extending in the direction of an optical axis, and the collar 17A can also be configured as an oblong collar whose major axis is shorter than the screw insert hole 16A. Although a cross-sectional structure of the screw insert hole 16A is omitted from the drawings, the bottom surface of the upper-level portion 16*a* is made in the form of the tapered surface 161, and the lower surface of the oblong collar 17A is formed into the shape of a corresponding tapered surface 171 as in the second exemplary embodiment. In the case of the structure, even when the fixing screw 62 is screw-engaged with the fixing screw hole 25, the oblong collar 17A contacts an oblong interior surface of the screw insert hole 16A, thereby effecting a whirl-stop. Therefore, a displacement force develops forwardly in the tapered surfaces 161 and 171, whereby positioning of the module substrate 11—namely, positioning of the light source module 1—can be performed. As mentioned above, in the second exemplary embodiment, the collars 17 or the collar 17A are provided so as not to rotate within the respective screw insert holes 16 and 16A when the fixing screws 62 are fastened. Therefore, although omitted from the drawings, the collars and the screw insert holes can also be formed into a hexagonal shape, an oblong shape, an elliptical shape, or the like.

Although the first and second exemplary embodiments have been described by reference to the case where the module substrate of the light source module is mounted directly on the support surface of the seat of the lamp unit, the present inventive concept can also be applied to a lamp unit in which the light source module is fixedly supported by way of an attachment. In this case, a support surface of the attachment is replaced with the seat described in connection with one of the first or second exemplary embodiments.

The light-emitting element is not limited to chip-shaped LEDs, such as those described above in connection with the first and second exemplary embodiments. The light source module may also use an LED of a discrete configuration. Further, the light-emitting element is not limited to the LED, but may alternatively be a laser diode. Moreover, the light source module according to exemplary embodiments of the present invention can alternatively be applied to a lamp unit other than the lamp unit described in connection with the first exemplary embodiment.

According to an illustrative aspect of the present invention, there is provided a light source module including a light emitting element; a module substrate on which the light emitting element is mounted; a support member including a position reference section; and a fixing member which fixes the module substrate to the support member. The module substrate includes a positioning section which contacts with the position reference section of the support member and determines position of the module substrate; and a displacement force generation section which imparts displacement force onto the module substrate so as to bring the positioning section into contact with the position reference section of the support member when the fixing member is fastened to the support member.

Accordingly, the fixing member is fastened to the support member, to thus fix the module substrate to the support member, whereby the light source module can be fixedly supported on the support member. Concurrently, a displacement force is induced in the module substrate by means of fastening action of the fixing member, thereby bringing the positioning section on the module substrate into contact with the position reference section on the support member. Thus, the light source module can be positioned. Therefore, so long as the light source module is fixedly supported, the light source module can be automatically positioned, and it is possible to simplify an assembly operation and to stably support the fixing members.

Moreover, the displacement force generation section may include a tapered portion, provided on the module substrate and positioned adjacent to the fixing member, and the tapered portion may abut with a part of the fixing member when the fixing member is fastened into the support member so as to generate the displacement force.

Accordingly, the displacement force is generated by abutting the fixing member into the tapered portion. The fixing member is fastened to the support member to fixedly support the substrate on the support member, and simultaneously, a contact force generated as a result of the fixing members contacting the tapered portions acts on the module substrate as displacement force. Then, positioning sections of the module substrate is brought into contact with a position reference section on the support member, to thus determine the position of the light source module.

The displacement force generation section may include a collar interposed between the fixing member and the module substrate, the collar including a tapered surface which contacts with a tapered surface provided on the module substrate, and the tapered surface may contact with the tapered surface of the substrate so as to generate the displacement force when the fixing member is fastened into the support member.

Accordingly, at the same time as the fixing member is fastened to the support member so as to fixedly support the substrate on the support member, a contact force generated as a result of abutment between the tapered surfaces of the collar and the substrate acts on the substrate as the displacement force. As a result, the positioning section of the substrate contacts with the position reference section of the support member so as to define the position of the light source module.

While the invention has been described in connection with certain exemplary embodiments thereof, those skilled in the art will understand that various changes and modifications may be made therein without departing from the present invention, and it is aimed, therefore, to cover in the appended claim all such changes and modifications as fall within the true spirit and scope of the present invention.

What is claimed is:

1. A light source module comprising:

a light emitting element;

a module substrate on which the light emitting element is mounted;

a support member comprising a position reference section; and a fixing member which fixes the module substrate to the support member, wherein the module substrate comprises:

a positioning section which determines a position of the module substrate; and a displacement force generation section which imparts a displacement force onto the module substrate so as to bring the positioning section into contact with the position reference section of the support member when the fixing member is fastened to the support member.

2. The light source module according to claim 1, wherein the displacement force generation section comprises a tapered portion, the tapered portion is provided on the module substrate and positioned adjacent to the fixing member, and the tapered portion abuts with a part of the fixing member when the fixing member is fastened into the support member so as to generate the displacement force.

3. The light source module according to claim 1, wherein the displacement force generation section comprises a collar interposed between the fixing member and the module substrate, the collar comprises a tapered surface which contacts with a tapered surface provided on the module substrate, and the tapered surface abuts with the tapered surface of the substrate so as to generate the displacement force when the fixing member is fastened into the support member.

4. A light source module comprising:

a support surface comprising a positioning member;

a module substrate comprising a reference member;

a light emitting element mounted on the module substrate; and means for attaching the module substrate to the support surface while displacing the module substrate such that the reference member contacts the positioning member.

5. The light source module according to claim 4, wherein in the support surface further comprises at least two auxiliary positioning members provided on the support surface so as to form a triangle with the positioning member, and the module substrate further comprises at least two auxiliary reference members positioned to correspond with the at least two auxiliary positioning members.

* * * * *